US008242874B2

(12) United States Patent
Pavlovic et al.

(10) Patent No.: US 8,242,874 B2
(45) Date of Patent: Aug. 14, 2012

(54) ELECTRICAL CONNECTOR HOUSING

(75) Inventors: Slobadan Pavlovic, Canton, MI (US); Mohamad Zeidan, Dearborn Heights, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 329 days.

(21) Appl. No.: 12/509,898

(22) Filed: Jul. 27, 2009

(65) Prior Publication Data

US 2009/0309689 A1 Dec. 17, 2009

Related U.S. Application Data

(63) Continuation-in-part of application No. 11/161,931, filed on Aug. 23, 2005, now abandoned.

(51) Int. Cl.

| | |
|---|---|
| ***H01H 85/20*** | (2006.01) |
| ***H01H 85/143*** | (2006.01) |
| ***H01H 85/50*** | (2006.01) |
| ***H01R 13/68*** | (2011.01) |

(52) U.S. Cl. ..... 337/187; 337/194; 337/196; 361/837; 439/620.01; 439/620.26

(58) Field of Classification Search ..... 337/187, 337/194, 196; 361/837; 439/620.01, 620.26, 439/830, 890

See application file for complete search history.

(56) References Cited

U.S. PATENT DOCUMENTS

| | | | | |
|---|---|---|---|---|
| 348,048 | A | | 8/1886 | Perkins |
| 743,471 | A | | 11/1903 | Downes |
| 945,017 | A | | 1/1910 | Cole |
| 1,158,535 | A | | 11/1915 | Murray |
| 1,857,442 | A | | 5/1932 | Dohrwardt |
| 1,966,716 | A | * | 7/1934 | Green ..... 337/194 |
| 1,993,866 | A | | 3/1935 | Steinmayer |
| 2,001,432 | A | | 5/1935 | Olving |
| 2,011,391 | A | | 8/1935 | Bennett |
| 2,011,543 | A | | 8/1935 | Meyer |
| 2,016,099 | A | | 10/1935 | Sandin |
| 2,186,813 | A | * | 1/1940 | Adam et al. ..... 337/210 |
| RE22,266 | E | | 2/1943 | Adam et al. |
| 2,700,712 | A | | 1/1955 | Stinson |
| 2,907,849 | A | | 10/1959 | Kobryner |
| 3,030,474 | A | * | 4/1962 | Scott, Jr. ..... 337/7 |
| 3,202,788 | A | | 8/1965 | Melvin |
| 3,358,100 | A | * | 12/1967 | Schleicher ..... 337/194 |
| 3,699,500 | A | | 10/1972 | Borzoni et al. |
| 4,178,061 | A | | 12/1979 | Ahroni |
| 4,613,195 | A | | 9/1986 | Suher et al. |
| 4,752,243 | A | | 6/1988 | Meidan |
| 4,997,394 | A | | 3/1991 | Katz et al. |

(Continued)

FOREIGN PATENT DOCUMENTS

DE 8601549 U1 3/1986

(Continued)

*Primary Examiner* — Anatoly Vortman
(74) *Attorney, Agent, or Firm* — Brooks Kushman, P.C.

(57) ABSTRACT

A fuse holder for an electrical fuse includes a first housing portion which has first and second electrical terminals disposed therein. A second housing portion is pivotally attached to the first housing portion, and is configured to carry the electrical fuse. Pivoting the first and second housing portions together automatically and sequentially connects the fuse carried by the second housing portion to the terminals disposed within the first housing portion. This provides a convenient mechanism for connecting and disconnecting the fuse, and facilitates the use of a fuse without its own insulating material.

14 Claims, 4 Drawing Sheets

U.S. PATENT DOCUMENTS

| | | | | |
|---|---|---|---|---|
| 5,145,414 | A | 9/1992 | Oikawa | |
| 5,221,217 | A | 6/1993 | Oikawa | |
| 5,748,068 | A | 5/1998 | Kiyota | |
| 5,752,856 | A | 5/1998 | Boutin et al. | |
| 5,820,413 | A | 10/1998 | Yamada et al. | |
| 5,841,337 | A * | 11/1998 | Douglass | 337/198 |
| 5,880,665 | A | 3/1999 | Yetter et al. | |
| 5,906,508 | A * | 5/1999 | Jeffcoat | 439/509 |
| 5,973,418 | A | 10/1999 | Ciesielka et al. | |
| 6,054,915 | A * | 4/2000 | Rowton et al. | 337/216 |
| 6,233,160 | B1 | 5/2001 | Shockley | |
| 6,333,845 | B1 * | 12/2001 | Hashizawa et al. | 361/642 |
| 6,366,449 | B1 * | 4/2002 | Hashizawa et al. | 361/642 |
| 6,587,028 | B2 | 7/2003 | Mollet et al. | |
| 6,650,222 | B2 * | 11/2003 | Darr et al. | 337/187 |
| 6,696,969 | B2 | 2/2004 | Torrez et al. | |
| 6,717,505 | B1 | 4/2004 | Bruchmann | |
| 6,727,797 | B1 | 4/2004 | Bruchmann | |
| 6,794,979 | B2 | 9/2004 | Sudan et al. | |
| 6,850,421 | B2 | 2/2005 | Boyd | |
| 6,853,289 | B2 * | 2/2005 | Scoggin | 337/194 |
| 7,750,789 | B2 * | 7/2010 | Titokis et al. | 337/194 |
| 7,893,809 | B2 * | 2/2011 | Head | 337/194 |
| 7,982,578 | B2 * | 7/2011 | Buettner | 337/196 |
| 8,026,786 | B2 * | 9/2011 | Darr et al. | 337/268 |
| 2002/0047770 | A1 | 4/2002 | Scoggin et al. | |
| 2004/0100786 | A1 | 5/2004 | Hong | |

FOREIGN PATENT DOCUMENTS

| | | | |
|---|---|---|---|
| DE | 10009605 | A1 | 10/2000 |
| GB | 2128042 | A | 4/1984 |
| GB | 2170067 | A | 7/1986 |

* cited by examiner

ELECTRICAL CONNECTOR HOUSING

CROSS-REFERENCE TO RELATED APPLICATIONS

This application is a continuation-in-part of U.S. patent application Ser. No. 11/161,931 filed 23 Aug. 2005, which is hereby incorporated herein by reference.

BACKGROUND OF THE INVENTION

1. Field of the Invention

The present invention relates to an electrical connector housing.

2. Background Art

Electrical circuits often include an electrical connector in the form of a fuse, which is designed to break the circuit upon the occurrence of a specified event—e.g., too much current flowing through the circuit. Some fuses, especially those used in high-power applications, utilize bolt-on connections which require utilization of torque guns or other tools to apply the appropriate torque to the bolts during installation of the fuse. In addition to adding complexity to the production, and potentially increasing costs, bolt-on fuse connections may fail if an improper torque has been applied during installation. This may be particularly true in rigorous automotive environments.

Although bolt-on connections have inherent limitations, they continue to be used in high-power applications, at least in part, because of the high temperatures associated with high current flow. Copper, which is a good electrical conductor, has a tendency to relax at high temperatures. This means that male and female slide terminals made from copper may not retain the necessary electrical contact with each other when used in a high-power application. Specifically, the clamping portion of a fuse body—e.g., the spring-type feature of the female terminals—which would otherwise maintain a tight connection with the male terminal blades, relaxes, thereby decreasing the overall contact area; this in turn reduces electrical conductivity and increases electrical resistance.

Other types of fuse solutions include fusible links, which may be prone to heat damage in an automotive environment, and can also have a high cost of service. In addition, using a fuse which includes its own insulating cover adds cost to the fuse because of the extra material and the increased complexity in production. Therefore, it would be desirable to have an electrical connector housing, such as a fuse holder, which eliminated the need for bolt-on fuse connections, even in high-power applications, and also facilitated the use of fuses devoid of insulating material.

SUMMARY OF THE INVENTION

Embodiments of the present invention provide an electrical connector housing which includes a first housing portion and a second housing portion. The first housing portion includes first and second electrically conducting elements, each of which has a first connector portion which is configured to cooperate with an electrical connector to electrically connect the first and second electrically conducting elements. At least one of the first and second electrically conducting elements is integrally formed with the first housing portion. The second housing portion is configured to cooperate with the first housing portion to at least partially enclose the first connector portion of each of the first and second electrically conducting elements and the electrical connector when the electrical connector is positioned to electrically connect the first and second electrically conducting elements.

Embodiments of the invention also provide a fuse holder for an electrical fuse, which includes a first housing portion having first and second electrical terminals. A second housing portion is configured to carry the electrical fuse, and is further configured to cooperate with the first housing portion such that the fuse carried by the second housing portion automatically electrically connects the first and second terminals when the first and second housing portions are disposed proximate each other in a first mating position.

Embodiments of the invention further provide a method of producing an electrical connector housing having first and second electrically conducting elements. The method includes molding a first housing portion defining an interior space. Each of the first and second electrically conducting elements includes a first connector portion disposed substantially within the interior space. The method also includes molding a second housing portion which is configured to cooperate with the first housing portion in a first mating position. The second housing portion includes a retaining structure configured to retain an electrical connector such that the electrical connector electrically connects the first and second electrically conducting elements when the first and second housing portions are placed in the first mating position.

Embodiments of the invention also provide an electrical connector housing that includes a fuse body having a first terminal receptor with a first set of terminal legs. The fuse body further includes a second terminal receptor having a second set of terminal legs, and which is disposed in spaced relation to the first terminal receptor. A fuse element is disposed between the first terminal receptor and the second terminal receptor. A first clamp-like member is mounted to the first terminal receptor and a second clamp-like member is mounted to the second terminal receptor. The clamp-like members apply compressive force to a respective set of terminal legs. A first housing portion includes first and second electrical terminals integrally molded with the housing. Each of the first and second electrical terminals includes: a first connector portion configured to cooperate with a respective one of the terminal receptors to electrically connect the first and second electrical terminals, and a second connector portion extending outwardly from the first housing portion and configured to receive an electrically conducting wire such that when the wires and the fuse body are electrically connected to the first and second electrical terminals, the wires have in-line fuse protection. A second housing portion is configured to cooperate with the first housing portion to at least partially enclose the first connector portion of each of the first and second electrical terminals and the fuse body when the fuse body is positioned to electrically connect the first and second electrical terminals.

DETAILED DESCRIPTION OF EMBODIMENTS OF THE INVENTION

Figure 1:
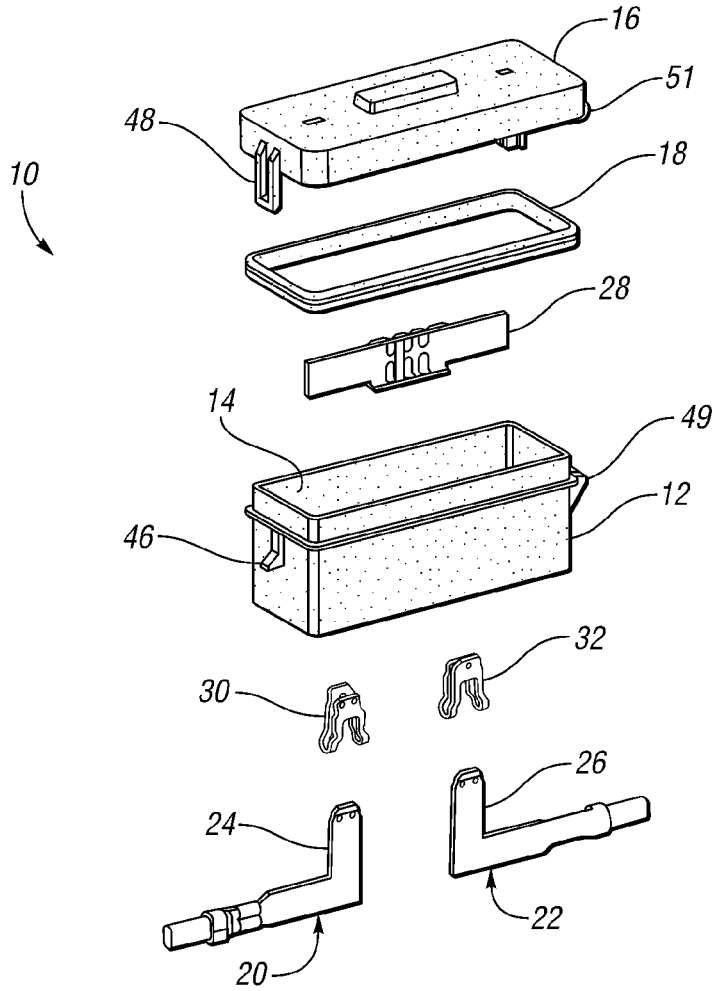
FIG. 1 shows an exploded view of an electrical connector housing and an electrical connector in the form of a fuse, in accordance with one embodiment of the present invention.

FIG. 1 shows an exploded view of an electrical connector housing, or fuse holder 10, in accordance with one embodiment of the present invention. The fuse holder 10 includes a first housing portion, or base 12, which defines an interior space 14. The fuse holder 10 also includes a second housing portion, or cover 16, and a seal 18 configured to be disposed between the base 12 and the cover 16. The fuse holder 10 also includes first and second electrically conducting elements, or terminals 20, 22. As shown in FIG. 1, the terminals 20, 22 are male terminals, which respectively include first connector portions 24, 26. As described more fully below, the first connector portions 24, 26 are configured to cooperate with an electrical connector, such as a fuse 28, to electrically connect the first and second terminals 20, 22. Also shown in FIG. 1 are first and second electrical attachment features, or female terminals 30, 32. The female terminals 30, 32 are spring terminals configured to be disposed on the first connector portions 24, 26 of the male terminals 20, 22; they are also configured to receive the fuse 28, which in the embodiment shown in FIG. 1, is a male connector.

Figure 2:
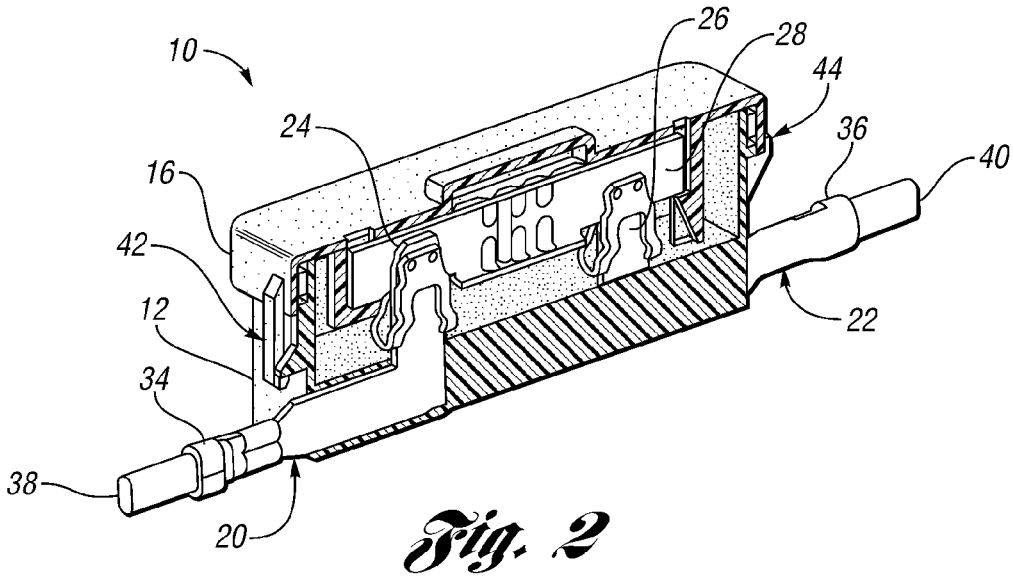
FIG. 2 shows a partial fragmentary assembled view of the electrical connector housing and fuse shown in FIG. 1.

FIG. 2 shows a partial fragmentary view of the fuse holder 10 with all of the components assembled. One method of producing the fuse holder 10 is to mold the base 12 from a polymeric or composite material. In automotive applications, where heat resistance is required, a polyamide with a 30% glass field has been shown to be effective. Of course, other materials may be used, including other polymers and composites, depending on the particular application. In the embodiment shown in FIG. 2, the terminals 20, 22 are integrally formed with the base 12. This can be done by a technique commonly known as "overmolding". Integrally molding the terminals 20, 22 with the base 12, provides a robust method of attachment, and isolates the fuse 28 from outside stresses, thereby providing a built-in strain relief.

The use of the separate female terminals 30, 32, which are installed after the base 12 is molded, helps to facilitate the overmolding process by reducing the complexity of the setup and/or tooling. In order to provide a good electrical contact surface, the first contact portions 24, 26 must be free of the material used to mold the base 12—e.g., the polyamide/glass material. Male terminals, such as the terminals 20, 22, are easier to shield from the molded material, and the female terminals 30, 32 are quickly and easily applied to the first contact portions 24, 26 after the base 12 is molded.

As shown in FIG. 2, each of the male terminals 20, 22 also includes a second connector portion 34, 36, respectively. The second connector portions 34, 36 are each configured to retain a wire 38, 40. As shown in FIG. 2, neither of the wires 38, 40 has a terminated end; rather, the end of each wire 38, 40 is crimped in a respective connector portion 34, 36. As discussed below, the second connector portions can be configured in virtually any shape effective to provide a connection point to another electrically conducting element, such as, a crimp terminal, a welding interface, or an eyelet or ring terminal. In the embodiment shown in FIG. 2, the second connector portions 34, 36 are oriented generally perpendicular to their respective first connector portions 24, 26. This may further help to reduce stress and/or strain on the fuse 28, because more of the terminals 20, 22 are molded into the base 12.

As shown in FIG. 2, the base 12 and the cover 16 cooperate with each other in a first mating position which is maintained by a latch mechanism 42 on one side, and a hinge mechanism 44 on the other. The latch mechanism 42 includes an attachment structure 46 and a receiving structure 48 (see FIG. 1) respectively molded with the base 12 and the cover 16. The receiving structure 48 is configured to receive the attachment structure 46 to help secure the base 12 to the cover 16. The hinge mechanism 44 includes first and second portions 49, 51 (see FIG. 1) also respectively molded with the base 12 and the cover 16. The hinge mechanism 44 allows the base 12 and the cover 16 to pivot relative to each other, which is best illustrated in FIG. 3.

Figure 3:
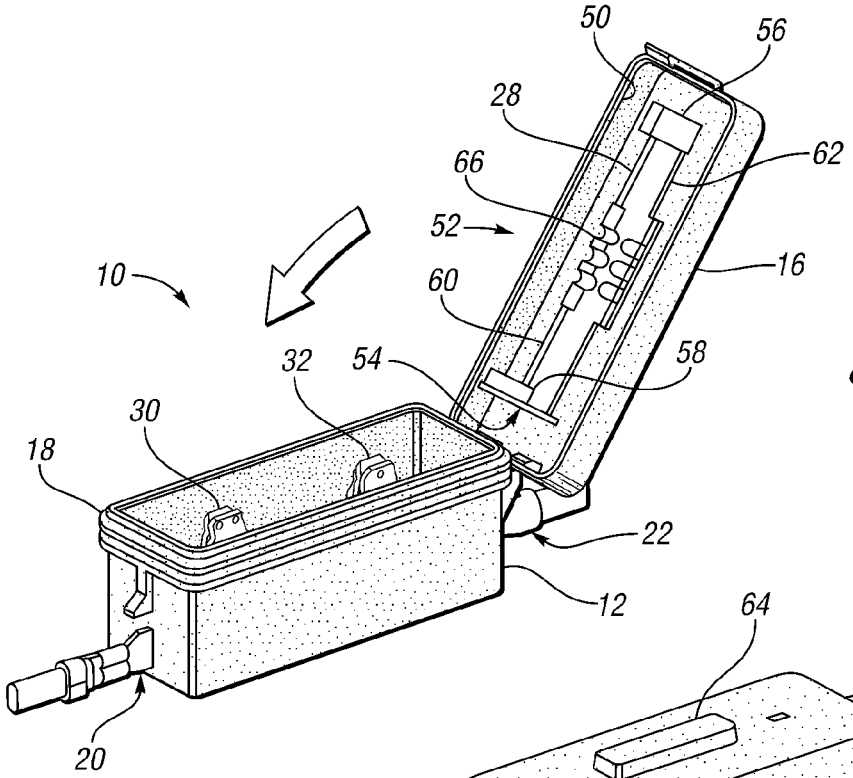
FIG. 3 shows an isometric view of the electrical connector housing and fuse shown in FIG. 1, with a first housing portion unlatched from a second housing portion.

Turning to FIG. 3, an inner portion 50 of the cover 16 is visible. The cover 16 includes a retaining structure 52 which includes first and second portions, or retaining elements 54, 56. The first retaining element 54 includes a lip 58 under which one end of the fuse 28 is placed. The other end of the fuse 28 is snapped into the second retaining element 56, which in the embodiment shown in FIG. 3, is configured as a clip. Like the base 12, and even the seal 18, the cover 16 may be conveniently molded of an appropriate material, such as a heat resistant polymer or composite. This allows the retaining structure 52 to be integrally molded with the cover 16, thereby eliminating the need for a separate assembly operation.

Once the fuse 28 is secured within the retaining structure 52, the cover 16 can be pivoted into the first mating position with the base 12. This movement is illustrated by the directional arrow shown in FIG. 3. As can be readily discerned from FIG. 3, the fuse 28 will be sequentially connected to the two terminals 20, 22 in the base 12 as the base 12 and the cover 16 are brought together into the first mating position. Specifically, a first portion 60 of the fuse 28 will be received by the female terminal 32 in the base 12. After contact is made, a second portion 62 of the fuse 28 will be received by the other female terminal 30. Thus, the fuse 28 may be connected to the female terminals 30, 32 one at a time, which reduces the insertion force necessary to connect the fuse 28 with the terminals 30, 32.

The retaining structure 52 is configured to hold the fuse 28 to allow it to be automatically connected to the terminals 30, 32 when the base 12 and the cover 16 are pivoted together into the first mating position. Similarly, the retaining structure 52 will retain the fuse 28 when the base 12 and the cover 16 are pivoted out of the first mating position. Thus, pivoting the cover 16 away from the base 12 will automatically disconnect the fuse 28 from the terminal 30, and then from the terminal 32, in reverse order of their connection. The configuration of the fuse holder 10 eliminates the requirement for insulation on a fuse that would otherwise be used to grip the fuse as it is inserted into an electrical circuit.

As shown in FIGS. 1-3, the fuse 28 is an all metal fuse, devoid of insulation. The cover 16 can be molded from a material which not only provides heat resistance for automotive environments, but also provides electrical insulation to isolate the fuse 28 from an operator opening or closing the housing 10. When the fuse 28 needs replacing, it is only necessary to replace the metal fuse 28 itself, the cover 16 may be reusable, in which case a new fuse is secured within the retaining structure 52 after the fuse 28 is removed. Alternatively, a number of covers, such as the cover 16, can be pre-loaded with fuses so that replacement of a fuse merely requires replacement of the cover—the fuse need never be removed from the retaining structure.

Figure 4:
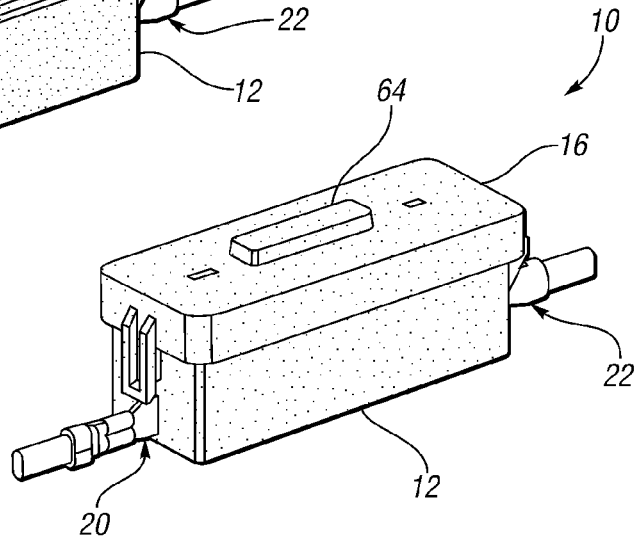
FIG. 4 shows an isometric view of the electrical connector housing shown in FIG. 3, with the first and second housing portions in a first mating position.

In FIG. 4, the base 12 and the cover 16 are shown in the first mating position. When they are in the first mating position, the base 12 and the cover 16 provide a substantially sealed enclosure for the fuse 28 and the associated electrical terminals 20, 22 and 30, 32. Also shown in FIG. 4, the cover 16 includes a protrusion 62 molded therein to accommodate a protruding portion 66 of the fuse 28 (see also FIG. 3). Although the housing portions 12, 16 do not need to be molded, or made from a polymeric material, it does provide a convenient method for producing a fuse holder, such as the fuse holder 10. Not only can the geometric configuration of the fuse holder 10 be modified to accommodate different styles of fuses and/or electrical terminals, but an appropriate choice of a polymeric material effectively insulates the electrical connectors, and eliminates the need to use a fuse having its own insulation.

Figure 5A:
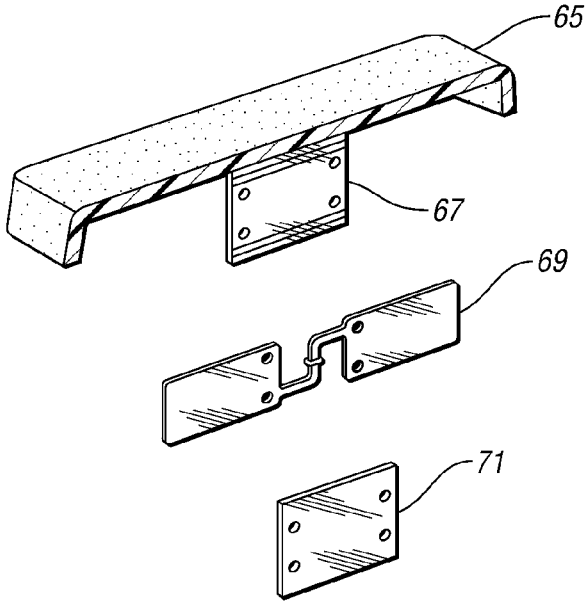
FIG. 5A shows a partial fragmentary exploded view of a fuse holder cover and fuse in accordance with another embodiment of the present invention.

FIG. 5A shows a portion of a second housing portion, or fuse holder cover 65, having a retaining structure that is different from the one shown in FIG. 3. Although the cover 65 is shown without latch and hinge mechanisms, such as the latch and hinge mechanisms 42, 44 shown in FIG. 2, it is understood that it may contain these or other attachment features so that it can cooperate with a base portion of a fuse holder. Integrally molded with the cover 65 is a first portion 67 of a retaining structure configured to carry a fuse 69. Separate from the first portion 67 is a second portion 71 of the retaining structure. Although the second portion 71 is separate from the cover 65, it could be molded substantially simultaneously with the cover 65, for example, in a separate cavity of the same mold tool.

Figure 5B:
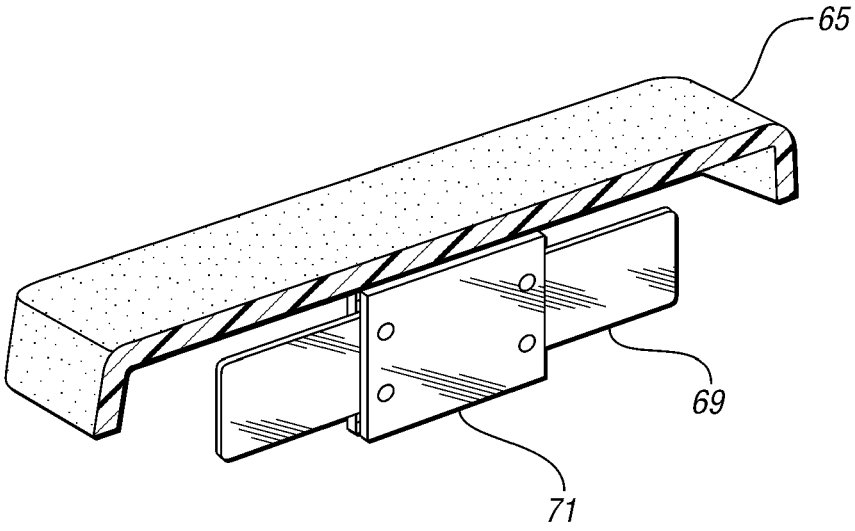
FIG. 5B shows a partial fragmentary assembled view of the fuse holder cover and fuse shown in FIG. 5A.

As shown in FIG. 5B, the first and second portions 67, 71 of the retaining structure cooperate to capture the fuse 69 between them. One convenient method of attaching the first and second portions 67, 71 together is to sonic weld them to each other. Alternatively, they could be heat-staked, or an adhesive could be used, depending on the particular application. As noted above, one convenient method of using a fuse holder in accordance with the present invention is to secure fuses into a number of respective fuse holder covers, such as the cover 65, and when a fuse needs replacing, the entire cover, including the fuse, is replaced.

Figure 6:
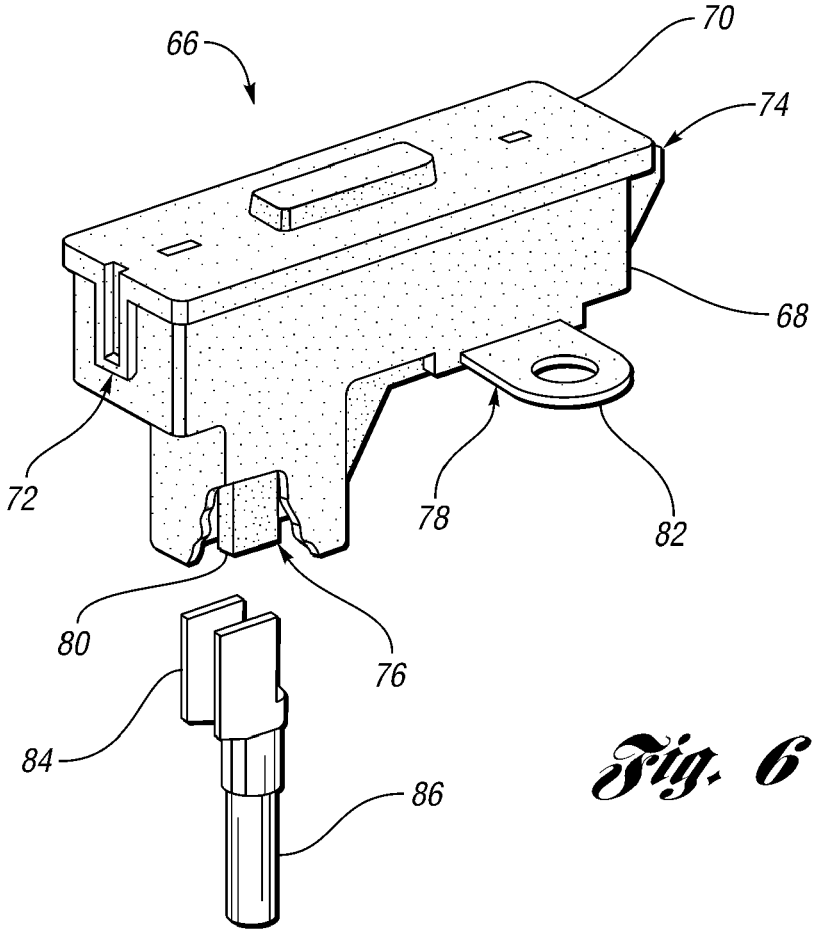
FIG. 6 shows an isometric view of an electrical connector housing in accordance with another embodiment of the present invention.

FIG. 6 shows an electrical connector housing, or fuse holder 66 in accordance with another embodiment of the present invention. Similar to the fuse holder 10, the fuse holder 66 includes first and second housing portions 68, 70 which cooperate with each other in a first mating position, as shown in FIG. 5. A latch mechanism 72 and a hinge mechanism 74 allow the first and second housing portions 68, 70 to be pivoted relative to each other, and securely latched in the first mating position. Although not visible in FIG. 6, first and second terminals 76, 78 each have first connector portions which are configured to receive female terminals to facilitate connection to a fuse, such as the fuse 28. In contrast to the fuse holder 10, the terminals 76, 78 have markedly different second connector portions 80, 82, respectively. The second connector portion 80 of the first terminal 76 is a thick male terminal that is configured to receive a fork terminal 84, which may be attached to an electrically conducting element, such as a wire 86. The second connector portion 82 of the second terminal 78 is a ring terminal, which facilitates secure attachment to another electrically conducting element (not shown) through the use of a bolt, or other stud-type fastener. It is worth noting that the embodiment shown in FIG. 6 represents just one variation of many different varieties of terminals which may be used with a fuse holder, in accordance with the present invention.

Figure 7A:
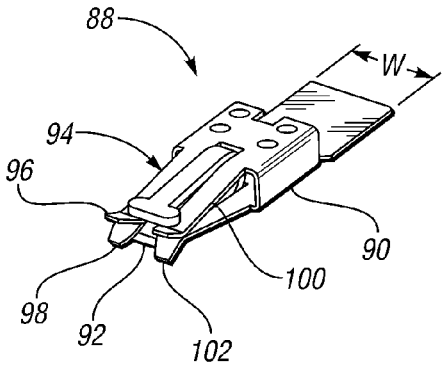
FIG. 7A shows an isometric view of a female electrical terminal in accordance with embodiments of the invention.

FIG. 7A shows a female electrical terminal 88. As explained below, the female terminal 88 can be used as an attachment structure, such as the female terminals 30, 32 shown in FIG. 1. The female terminal 88 includes a terminal receptor 90, and a clamp-like member 92. The terminal receptor 90 can be made, for example, from a single piece of stamped metal, such as copper. The terminal receptor 90 includes a first set of terminal legs 94, which includes first and second opposing legs 96, 98 and third and fourth opposing legs 100, 102. Each of the legs 96-102 are resilient for maintaining a compressive force on a male electrical terminal blade, such as the male terminals 20, 22 shown in FIG. 1.

Figure 7B:
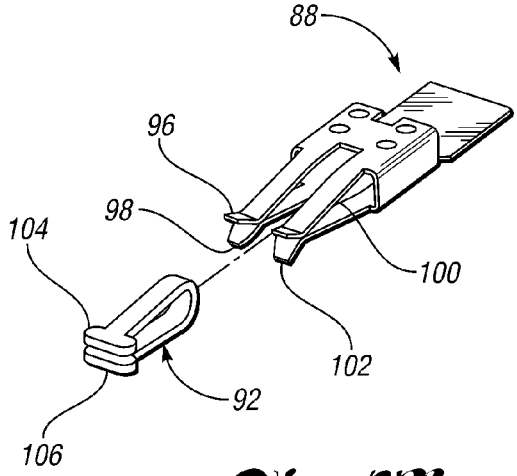
FIG. 7B shows an exploded view of the female terminal shown in FIG. 7A.

As shown in FIG. 7B, the first and third legs 96, 100 are spaced in relation to one another, as are the second and fourth legs 98, 102. This allows the clamp-like member 92 to be inserted therebetween, as shown in the assembled view in FIG. 7A. The clamp-like member 92 is configured as a substantially U-shaped body having first and second end portions 104, 106. The first and second end portions 104, 106 may have an arc-shaped cross section furthering the nesting relationship between the first end portion 104 and the first and third legs 96, 100, and the second end portion 106 and the second and fourth legs 98, 102.

The clamp-like member 92 may be made from a material having low relaxation properties at elevated temperatures, for example, 301 stainless steel. Because of this property, and the compressive force that the clamp-like member 92 can apply to the legs 96-102 of the female terminal 88, the terminal receptor 90 can be made from a highly conductive material, such as C151 copper. Without the use of the clamp-like member 92, higher temperature applications—such as high power applications where more than 70 amperes (A) of current may be present—may require the terminal receptor 90 to be made from a copper alloy having better mechanical properties at higher temperatures, but poorer conductivity than the more pure copper material.

Figure 8A:
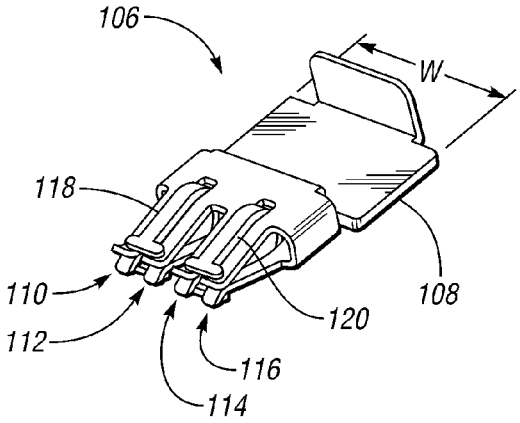
FIG. 8A shows an isometric view of a female electrical terminal in accordance with embodiments of the invention.
Figure 8B:
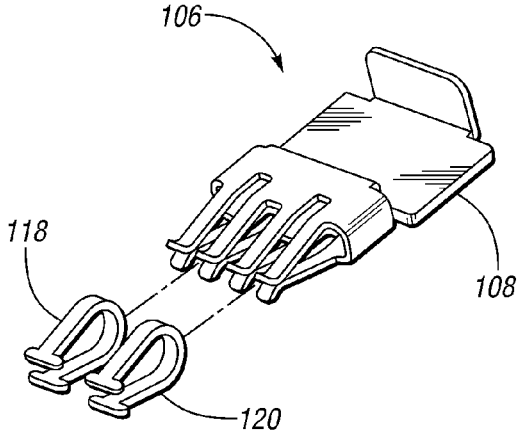
FIG. 8B shows an exploded view of the female terminal shown in FIG. 8A.

The female terminal 88 may have a width (W) of a little over 6 millimeters (mm). A terminal of this size, when used with the clamp-like member 92, may be used in applications requiring up to 130 A. Where higher current applications are contemplated, a terminal, such as the female terminal 88 shown in FIGS. 7A and 7B, can be made wider such as illustrated in FIGS. 8A and 8B. In FIGS. 8A and 8B, a female terminal 106 has a width (W) of approximately 14.5 mm. The female terminal 106 includes a terminal receptor 108 and four sets of opposing terminal legs 110, 112, 114, 116. The female terminal 106 also includes two clamp-like structures 118, 120, each configured to cooperate with two sets of the legs 110-116 to apply a compressive force to a male terminal that will be inserted therebetween. FIG. 8B shows an exploded view of the terminal 106, illustrating the clamp-like members 118, 120 detached from the legs 110-116.

Figure 9:
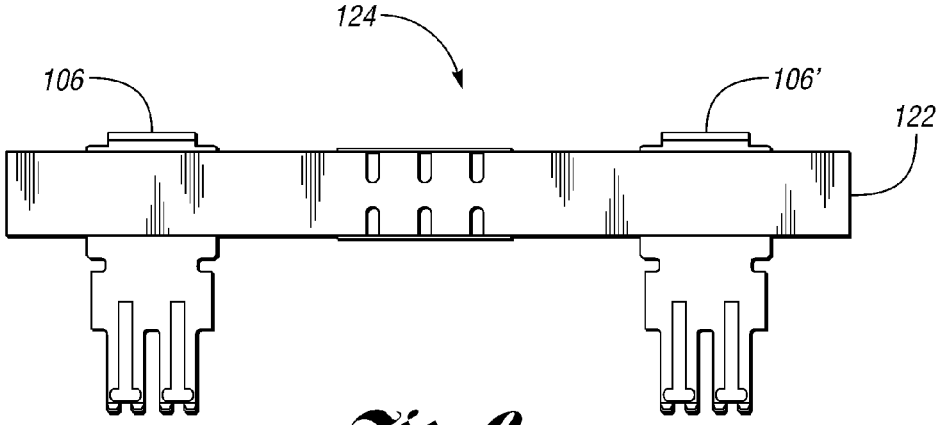
FIG. 9 shows a fuse body in accordance with embodiments of the invention.

FIG. 9 shows the female terminal 106, in conjunction with another similarly configured terminal 106' being used in conjunction with a fuse or fuse element 122, and forming a fuse body 124. The fuse element 122 electrically connects the female terminals 106, 106', and is therefore an electrical connector, such as element 28, shown in FIG. 1. In the embodiment shown in FIG. 9, the fuse element 122 is welded to the female terminals 106, 106', thereby forming an assembly that can be inserted into the lid of a housing, such as the cover 16 shown in FIG. 1. Other types of attachments are also contemplated, for example, depending on the particular application, spot welding or adhesive connections may be used. In addition, a fuse element can be integrally formed with terminal receptors. Such a configuration is described in U.S. Patent Application Publication No. 2009/0085712, entitled "High Power Case Fuse" and published on 2 Apr. 2009, which is hereby incorporated herein by reference.

Where a fuse body, such as the fuse body 124, is used, separate attachment structures such as terminals 30, 32 are not required, as the female terminals 106, 106' will directly mate with the first connector portions 24, 26 of the male terminals 20, 22. As noted above, the smaller width terminal 88, shown in FIGS. 7A and 7B can be used in applications at least up to 130 A. In contrast, the "double-width" terminals 106, 106' can be used in applications up to at least 500 A. In these applications it may be particularly important to utilize an electrical connector housing, such as illustrated in FIGS. 1-6 so that technicians are isolated from the conducting elements when contact is made. Moreover, the high power terminals used in the present invention, such as the terminals 88, 106 provide for fast electrical connections that do not require bolt-on attachments which may otherwise be required for such high power applications.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical connector housing, comprising:

a first housing portion including first and second electrically conducting elements, each of the first and second electrically conducting elements having first and second connector portions, each of the first connector portions including a respective male blade and being configured to cooperate with an electrical connector to electrically connect the first and second electrically conducting elements, each of the first and second electrically conducting elements being integrally molded with the first housing portion such that a built-in strain relief is provided for the electrical connector when the electrical connector connects the first and second electrically conducting elements;

a pair of female electrical terminals configured for connection to a corresponding one of the male blades; and a second housing portion configured to cooperate with the first housing portion to at least partially enclose the first connector portion of each of the first and second electrically conducting elements and the electrical connector when the electrical connector is positioned to electrically connect the first and second electrically conducting elements, each of the second connector portions extending outwardly from the first housing portion such that they are accessible from outside the first housing portion when the first and second housing portions are cooperating to at least partially enclose the first connector portions, each of the second connector portions being configured to receive a wire to provide an in-line connection of the wires when the electrical connector is positioned to electrically connect the first and second electrically conducting elements.

2. The electrical connector housing of claim 1, wherein the female electrical terminals comprise first and second electrical attachment features configured for respective attachment to the first connector portion of the first and second electrically conducting elements, and further configured for attachment to the electrical connector, thereby facilitating an electrical connection between the first and second electrically conducting elements and the electrical connector.

3. The electrical connector housing of claim 1, wherein the first and second housing portions are configured to cooperate in a first mating position, and the second housing portion is further configured to retain the electrical connector therein such that the electrical connector is automatically electrically connected to the first and second electrically conducting elements when the first and second housing portions are in the first mating position.

4. The electrical connector housing of claim 3, wherein each of the second connector portions are disposed generally perpendicularly to a respective first connector portion, thereby further reducing strain on the electrical connector when it is electrically connected to the first and second electrically conducting elements.

5. The electrical connector housing of claim 3, wherein the electrical connector includes a metal fuse element substantially devoid of insulating material.

6. The electrical connector housing of claim 3, wherein the first and second housing portions are pivotally attached to each other such that pivoting one of the housing portions into the first mating position with the other housing portion, when the electrical connector is retained by the second housing portion, electrically connects the electrical connector to the first and second electrically conducting elements sequentially.

7. The electrical connector housing of claim 6, wherein the second housing portion is further configured to retain the electrical connector therein such that the electrical connector is automatically electrically disconnected from at least one of the first and second electrically conducting elements when one of the housing portions is pivoted out of the first mating position with the other housing portion.

8. The electrical connector housing of claim 1, wherein the electrical connector includes:

a fuse body having the female electrical terminals attached thereto, each of the female electrical terminals including:

a first terminal receptor including a first set of terminal legs, a second terminal receptor in spaced relation to the first terminal receptor and including a second set of terminal legs, and a fuse element disposed between the first terminal receptor and the second terminal receptor, a first clamp-like member mounted to the first terminal receptor for applying a compression force against the first set of terminal legs that is configured to secure a first of the male blades between the first set of terminal legs, and a second clamp-like member mounted to the second terminal receptor for applying a compression force against the second set of terminal legs that is configured to secure a second of the male blades between the second set of terminal legs.

9. The electrical connector housing of claim 8, wherein the first and second sets of terminal legs are welded to the fuse element.

10. The electrical connector housing of claim 8, wherein each of the blades is configured to cooperate with a respective one of the sets of terminal receptors for effecting an electrical connection.

11. A fuse holder for a high power electrical fuse, the fuse holder comprising:

a first housing portion including first and second male electrical terminals integrally molded therewith;

a second housing portion configured to carry the electrical fuse, and being further configured to cooperate with the first housing portion such that the fuse carried by the second housing portion electrically connects the first and second terminals when the first and second housing portions are disposed proximate each other in a first mating position, the integrally molded first housing portion and electrical terminals providing a built-in strain relief for the fuse when the fuse connects the first and second electrical terminals, wherein each of the first and second terminals includes a connector portion extending outwardly from the first housing portion and accessible from outside the first housing portion when the first and second housing portions are in the first mating position, each of the connector portions being configured to receive an unterminated wire to provide in-line fuse protection for the wires when the first and second housing portions are in the first mating position; and a pair of female electrical terminals configured to electrical connection to a corresponding one of the male electrical terminals, and further configured for electrical connection to the fuse.

12. The fuse holder of claim 11, wherein each of the female electrical terminals are welded to the fuse.

13. The fuse holder housing of claim 11, further comprising a seal configured to be disposed between the first and second housing portions in the first mating position, thereby providing a substantially sealed enclosure for the fuse.

14. The fuse holder housing of claim 11, wherein each of the second connector portions are disposed generally perpendicularly to a respective first connector portion, thereby further reducing strain on the fuse when it is electrically connected to the first and second terminals.

* * * * *

UNITED STATES PATENT AND TRADEMARK OFFICE

CERTIFICATE OF CORRECTION

PATENT NO. : 8,242,874 B2
APPLICATION NO. : 12/509898
DATED : August 14, 2012
INVENTOR(S) : Slobadan Pavlovic et al.

It is certified that error appears in the above-identified patent and that said Letters Patent is hereby corrected as shown below:

Column 10, Line 8, Claim 11:

After “electrical terminals configured” delete “to”
And insert -- for --.

Signed and Sealed this
Twenty-second Day of January, 2013

David J. Kappos

David J. Kappos
*Director of the United States Patent and Trademark Office*